US006923630B2

(12) United States Patent
Allen

(10) Patent No.: US 6,923,630 B2
(45) Date of Patent: Aug. 2, 2005

(54) APPARATUS AND METHOD FOR IMPRESSING PATTERNS IN A SLIP-FORMED CONCRETE WALL

(75) Inventor: Michael B. Allen, Stockton, CA (US)

(73) Assignee: Slipstone, Inc., French Camp, CA (US)

( * ) Notice: Subject to any disclaimer, the term of this patent is extended or adjusted under 35 U.S.C. 154(b) by 347 days.

(21) Appl. No.: 09/918,617

(22) Filed: Jul. 30, 2001

(65) Prior Publication Data

US 2003/0020191 A1 Jan. 30, 2003

(51) Int. Cl.[7] ..... B28B 11/08

(52) U.S. Cl. ..... 425/63; 425/89; 425/101; 425/363; 425/385

(58) Field of Search ..... 425/89, 363, 385, 425/471, 63, 101; 404/124, 128

(56) References Cited

U.S. PATENT DOCUMENTS

| | | | | | |
|---|---|---|---|---|---|
| 2,252,188 | A | * | 8/1941 | Krehbiel | 404/95 |
| 3,832,079 | A | | 8/1974 | Moorhead | |
| 3,994,639 | A | * | 11/1976 | Hewitt | 425/64 |
| 4,028,036 | A | * | 6/1977 | Farfor | 425/385 |
| 4,101,255 | A | | 7/1978 | Fernaeus et al. | |
| 4,105,816 | A | | 8/1978 | Hori | |
| 4,211,743 | A | * | 7/1980 | Nauta et al. | 425/363 |
| 4,271,111 | A | * | 6/1981 | Sheber | 264/71 |
| 4,781,558 | A | * | 11/1988 | Betzner | 425/385 |
| 5,033,906 | A | | 7/1991 | Jordan | |
| 5,202,132 | A | * | 4/1993 | Myers et al. | 425/385 |
| 5,318,426 | A | * | 6/1994 | Hanson et al. | 425/64 |
| 5,354,189 | A | * | 10/1994 | McKinnon | 425/64 |
| 5,421,670 | A | * | 6/1995 | Meirick | 425/385 |
| 6,293,728 | B1 | * | 9/2001 | Eggleton et al. | 404/98 |
| 6,331,105 | B1 | * | 12/2001 | Lee | 425/324.1 |

FOREIGN PATENT DOCUMENTS

| | | |
|---|---|---|
| DE | 214 934 C | 10/1909 |
| DE | 22 32 305 A | 1/1973 |
| DE | 100 50 133 A1 | 5/2001 |

OTHER PUBLICATIONS

Quick Imprint Systems, Inc., Internet Advertisement, Commercial Photos, www.concreteroller.com/com_photos.htm, 2 pages, Feb. 27, 2004.

Quick Imprint Systems, Inc., Internet Advertisement, About Our Company, www.concreteroller.com/aboutus.htm, 1 page, Feb. 27, 2004.

Quick Imprint Systems, Inc., Brochure, New Breakthrough—Reusable Printed Liners, 3 pages, undated.

* cited by examiner

*Primary Examiner*—James P. Mackey
(74) *Attorney, Agent, or Firm*—John P. O'Banion; R. Michael West

(57) ABSTRACT

An apparatus and a method for impressing three-dimensional patterns in a slip-formed concrete wall. At least one impression roller is provided at the discharge end of a slip form. The impression roller includes an outer periphery, provided with a layer or coating of resilient material. The layer is pre-formed or pre-cast to include an aesthetically pleasing, three-dimensional pattern. The axis of the roller is maintained in parallel relation to the plane of the exposed surface of the wall, with the outer periphery of the roller slightly depressed into the wall surface. As the uncured concrete wall emerges from the slip form, the impression roller places a pattern into the wall surface which corresponds to the pattern on the roller. Movement of the roller along the wall causes the impression roller to rotate, impressing successively formed portions of the wall with the pattern. Additional rollers may be used to impress patterns on the opposing wall surface, as well as the top wall surface. After the concrete wall has fully cured, stain, paint, or other decorative features may be applied to the pattern, adding further visual interest and variety.

24 Claims, 5 Drawing Sheets

APPARATUS AND METHOD FOR IMPRESSING PATTERNS IN A SLIP-FORMED CONCRETE WALL

BACKGROUND OF THE INVENTION

1. Field of the Invention

The invention relates generally to devices for slip-forming concrete structures, such as divider walls, retaining walls, and other vertically extending barriers. More specifically, the invention pertains to an apparatus including one or more impression rollers, strategically positioned at the discharge end of a slip-form, to impress aesthetic patterns on the sidewalls and on the top wall of the slip-formed structure, just after the structure has been formed and before the concrete has cured.

2. Description of the Prior Art

Concrete walls have long been employed in freeway construction, both as divider walls between opposing directions of traffic, and as retainer walls extending along the sides of the outermost freeway lanes. Concrete walls are also used as barrier walls along property lines, and as aesthetic features in industrial or commercial landscaping. The need for concrete walls also arises to prevent erosion along the periphery of man-made lakes, and along river banks and coast lines.

Historically, concrete forms have been constructed from plywood and restraining posts assembled on the wall site, to shape, size, and direct the wall. After the concrete has been poured into the form and has cured sufficiently, the form is disassembled and another form is constructed for the adjacent wall section. This process is both labor intensive, and slow, owing to the amount of construction and disassembly of forms which it necessitates.

A relatively recent development in the concrete wall construction industry, is the application of a technique known as slip-forming. Instead of constructing a form on site, a mobile slip form is used. The mobile slip form is mounted to the frame of a motorized vehicle. A guide line is laid out defining one edge of the wall to be formed. The frame of the vehicle includes fore and aft alignment rods, maintained in contingent relation with the guide line by the operator.

As the motorized vehicle progresses forwardly down the guide line, fresh concrete is continuously poured into the slip form. The slump and constituent materials of the concrete mix are such that multiple vibrators, immersed within the slip form, are necessary to ensure thorough consolidation of the mix. When the formed concrete emerges from the output, or trailing edge of the form, it has smooth sidewalls and a smooth top wall.

If the slip-formed wall is relatively short, on the order of three to four feet, the entire wall including a spread footer, can be formed without structural reinforcement, in a single pass of the slip-form machine. If the wall is higher, a reinforcement bar cage is typically used in combination with a larger and formed, footer. Although the reinforcement cage must be constructed beforehand, the slip-form concrete pour technique has still been accomplished in a single pass of the slip-form machine, even for a tall wall up to eight feet, or so.

There are a number of commercially available slip-form machines. One such machine is the Commander III, manufactured by the GOMACO Corporation, of Ida Grove, Iowa. This machine has been used successfully to slip-form vertical walls up to 8'8" high, and to slip-form roadways. At least one paving operation at a dairy farm is known, using the Commander III, in which a free-floating steel roller was used to imprint a cobblestone pattern on the flat surface of the just-formed concrete roadway. The roller included rigid, rib-like protrusions on its outer periphery, corresponding to the cobblestone pattern. The pattern was impressed in the roadway to provide traction for the cattle, to keep their feet from slipping.

However, when slip-forming walls using known prior art machines, the sidewalls and the top wall emerge from the form uniformly smooth, and cure having the same smooth appearance. These walls have been recognized as visually unappealing for certain applications, so surface amendments have been added to the smooth surface. Walls have been colored with stain or paint, or decorative plates have been applied to the smooth walls after the concrete has set. These surface amendments consume additional time and materials, and increase the overall cost of the wall construction.

Therefore, the need exists for an apparatus which slip-forms a wall and concurrently creates a visually appealing pattern or impression in the surface of at least one sidewall of the wall.

The need exists for an apparatus which can be used in conjunction with existing slip-form machines, to impress a visually appealing pattern in the exposed surface of a slip-form wall just after it emerges from the slip form.

The need also exists for an apparatus which slip-forms a wall and concurrently creates patterns or impressions in both surfaces of the sidewalls and in the top wall.

The need also exists for an apparatus which includes an impression roller which is easily and quickly interchangeable with another impression roller, to create a wide variety of different patterns or impressions in a slip-formed wall.

The need further exists for a two-stage impression roller for use with an apparatus manufacturing a slip-formed concrete wall, which concurrently creates patterns or impressions both in the surface of a vertical sidewall portion and in the surface of an angled stem portion of the wall.

Lastly, the need exists for an impression roller for use with an apparatus manufacturing a slip-formed concrete wall, creating a substantially continuous pattern or impression which repeats along the extent of the wall.

SUMMARY OF THE INVENTION

The present invention provides both an apparatus and a method for impressing three-dimensional patterns in the exposed surface of a slip-formed concrete wall.

At least one impression roller is provided at the discharge end of the slip form. The roller includes a rigid inner form, preferably right-circular cylindrical in configuration. The inner form has an axis of rotation, which is maintained in generally parallel relation to the exposed surface of the wall.

An outer layer or coating of resilient material, such as silicon, is provided on the outer surface of the inner form. Typically, the layer is pre-cast on a shallow, horizontal casting frame. The casting frame is provided with a lower surface, configured in an aesthetically pleasing pattern. The material is filled to the top edge of the frame, forming a lower patterned side and an upper flat side. After the layer of material has cured, the layer is removed from the casting frame. The flat side of the resilient layer is then adhesively applied entirely around the outer surface of the inner form of the roller, so that the patterned side of the layer faces outwardly.

Virtually any pattern may be used, but typical patterns include a random arrangement of stones and mortar lines, a linear arrangement of bricks and mortar lines, and geometric designs comprised of straight or curved lines. The pattern may also include matching edge portions, along a vertical line extending from the top to the bottom of the impression roller. In this instance, the patterns along one mating edge of the layer match the patterns along the other mating edge of the layer.

The impression roller is preferably mounted to the same movable frame which supports and transports the slip-form. The roller is adjustably mounted to the frame, and positioned so that the outer peripheral portion of the roller depresses slightly into the outer surface of the wall just as the freshly-formed wall emerges from the slip-form. Owing to the surface engagement between the wall surface and the outer periphery of the impression roller, the roller rotates continuously with the relative movement between the roller and the slip-formed wall. As a consequence, successive portions of the uncured, wet concrete are impressed with a pattern which corresponds to the pattern on the impression roller.

The outer surface of the roller is continuously sprayed with a liquid release agent, so the wet concrete will not stick to the roller surface. Alternatively, a film material, such as VISQUINE, may be continuously rolled out over the surface of the wet concrete before the roller comes into contact with the exposed surface of the wall. In this way, the roller will not come into direct contact with the wet concrete, and the roller surface will not attract or become fouled with concrete. Later, after the concrete has at least partially cured, the film material is peeled from the wall and the impressed pattern is apparent.

If the pattern includes matching edges, the pattern will continuously and seamlessly repeat itself along the wall surface. Entirely different patterns may be used across the horizontal or vertical extent of the impression roller. Additional rollers may be used to impress patterns on opposing vertical wall surfaces, as well as upon the top wall surface. Also, a two-stage impression roller, having one surface parallel to the roller axis and another surface angled with respect to the roller axis, may be used to form impressions simultaneously in a vertical wall and in its angled supporting foot portion.

These and other features of the invention will now be described in further detail in the drawings and the detailed description of the preferred embodiment to follow.

DETAILED DESCRIPTION OF THE PREFERRED EMBODIMENT

Figure 1:
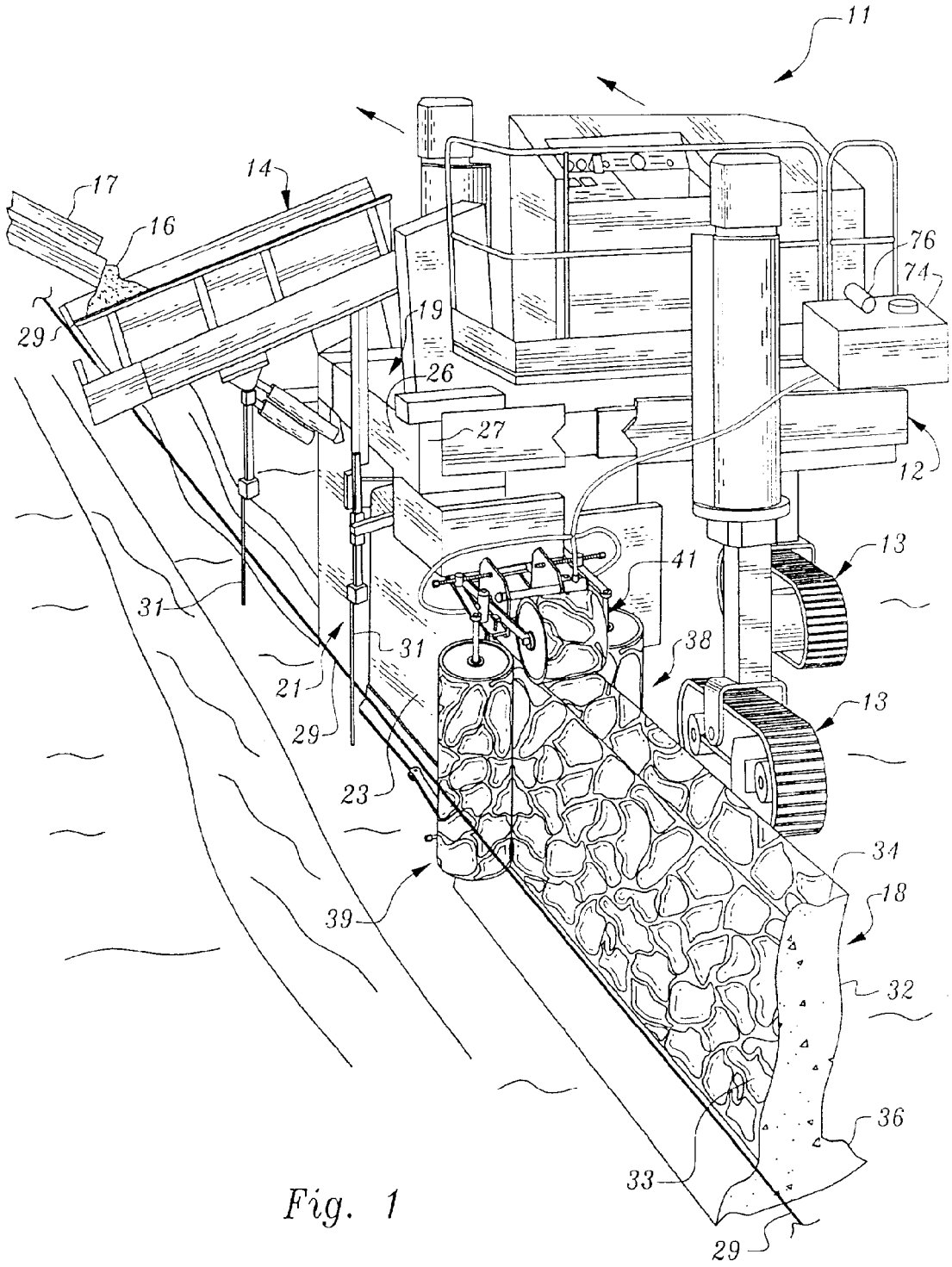
FIG. 1 is a right rear perspective view of a slip-form machine fitted with the sidewall and the top wall impression rollers of the present invention.

Turning now to FIG. 1, the apparatus 11 of the present invention includes a frame 12, supported for forward advancement over the ground by a number of continuous track drive feet 13. Because various machines for slip-forming walls or vertical barriers are well known in the art, their structure and operation will not be described in great detail herein. However, several key components are included in all such machines in one form or another, and they will be generally described herein so as to further the understanding of the overall operation of the present invention.

A concrete elevator 14 is located at the forward end of the apparatus. Concrete 16 is delivered into the elevator 14 by means of a chute 17, extending from a concrete truck (not shown). The consistency of this concrete is quite viscous, having approximately a 1½" slump. In addition, the concrete used for this application has a somewhat higher percentage of aggregate than the normal concrete mix. Both of these factors ensure that when the concrete wall 18 or vertical barrier emerges from the slip-forming process, the wall will be entirely self-supporting and cure without deformation.

A continuous supply of fresh wet concrete, delivered off the upper end of the elevator 14, is fed into an entry end 19 of a slip-form assembly 21. Slip-form assembly 21 includes a pair of parallel side wall forms 22 and 23, and a top wall form 24. Side wall forms 22 and 23 are spaced apart a distance corresponding to the transverse dimension of concrete wall 18. Top wall form 24 is perpendicular to both of the side walls, and spans the transverse dimension between them.

Figure 4:
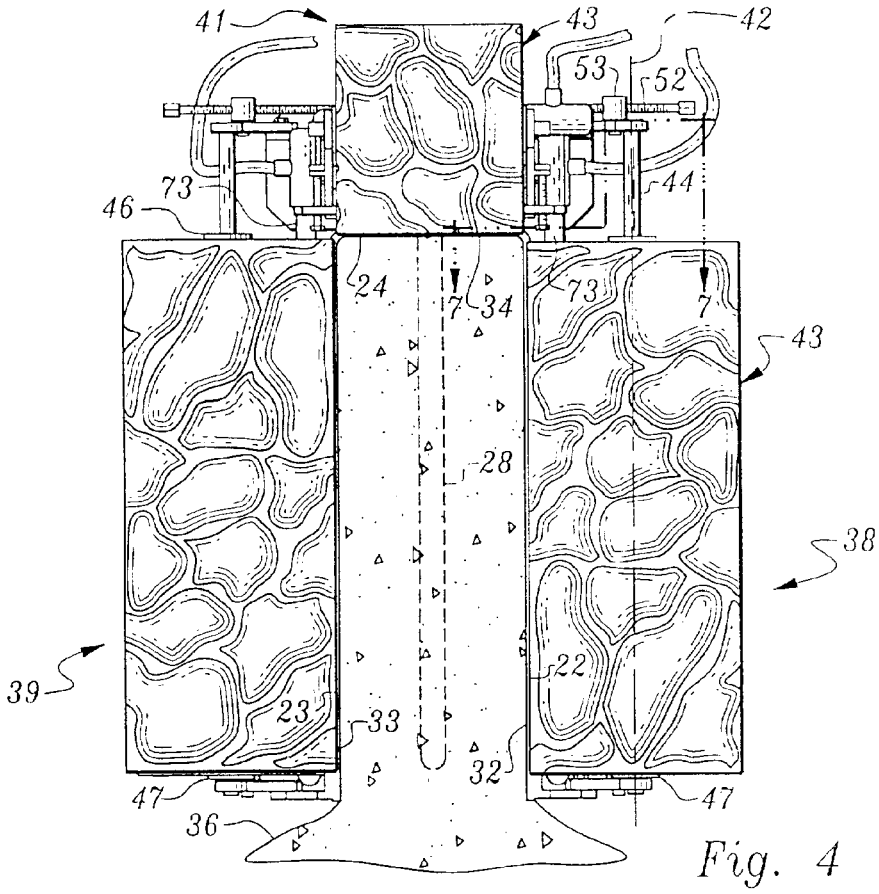
FIG. 4 is a rear elevational view, showing the three impression rollers, the slip-form, and the slip-formed wall with its footing.
Figure 5:
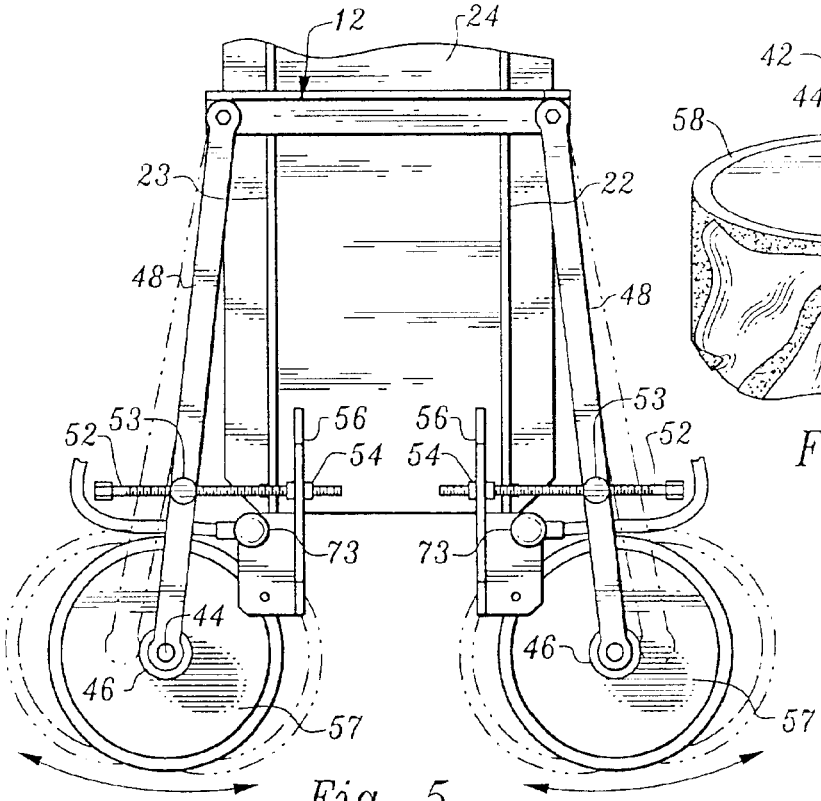
FIG. 5 is a top plan view of the sidewall impression rollers, showing their adjustable mounting feature.

A pair of side panels 26 and a pair of end panels 27 define an open top hopper, surrounding the entry end 19. The side and end panels are effective to confine and accumulate a sufficient amount of concrete so that the entry end of slip-form assembly 21 is maintained full of concrete at all times. Having a continuous oversupply of concrete present in the entry end, helps to ensure that the slip-formed concrete wall 18 will not contain side voids or internal air pockets. However, as the concrete mixture is very dry and it contains significant amounts of aggregate, manual agitation of the concrete within the slip-form is also necessary. An agitator, having an elongated mixing probe 28 shown in broken line in FIG. 4, causes the dry concrete mixture to disperse and mix throughout the interior volume of the slip-form. Although the mixing probe of only a single agitator is shown in the drawings, multiple mixing probes and agitators are typically employed in commercial slip-form machines.

As the concrete fills the slip-form assembly, the apparatus 11 advances forwardly and continuously, along a predetermined path. For that purpose, a guide line 29 is vertically spaced from the ground, along the path which is desired for the concrete wall 18. The guide line may be laid out in any direction or fashion, so that straight, angled, or curved walls may be produced. Plural alignment rods 31, depending from the side of the apparatus 11, are maintained in contingent relation with guide line 29 as the apparatus advances forwardly.

The concrete wall formed by the process includes a first sidewall 32, an opposing, second sidewall 33, a top wall 34, and a footing 36. As the bottom edges of the slip form assembly 21 are maintained in vertically spaced relation from the ground, concrete 16 passing downwardly through the slip-form pushes outwardly from beneath the slip form, naturally forming the footing 36. The footing may be left with a rough, unfinished surface, which is later covered with dirt. A trench (not shown) may also be excavated beforehand, so that the footing rests within the trench below grade. By the time the concrete reaches a discharge end 37 of the slip-form assembly 21, the concrete wall 18 is fully formed, self-supporting, and ready for curing. The concrete of the just-emerged wall is still wet, and has smooth vertical sidewalls and a smooth top wall.

The primary purpose of the present invention is to impress an aesthetic three-dimensional pattern into an exposed smooth surface of the slip-formed wall 18 before the concrete cures. To accomplish that purpose, sidewall impression rollers 38 and 39, and top wall impression roller 41 are provided. Impression rollers 38, 39 and 41 are all of substantially identical construction, although their sizes may vary with the particular application. Thus, in the discussion to follow, identical numerals will be used to identify identical structural elements for the various impression rollers.

Sidewall impression roller 38 is elongated, and preferably right-circular cylindrical in configuration. Roller 38 has an axis of rotation 42 and a resilient outer periphery 43 impressed with a three-dimensional pattern. An axle 44 passes through an upper bearing 46 and a lower bearing 47 at upper and lower ends of the roller 38, to support the roller for rotation about axis 42. An upper support arm 48 and a lower support arm 49, are pivotally attached at their inner ends to respective portions of frame 12. Axle 44 is attached to the outer ends of support arms 48 and 49.

Support arms 48 and 49 are adjustable about their pivotal attachments by means of a threaded rod assembly 51. Assembly 51 includes a threaded rod 52, a threaded cylindrical stub 53, and a threaded captive ball coupler 54. Cylindrical stub 53 is mounted for rotation on support arm 48. The housing of ball coupler 54 is affixed to a plate 56, but the captive threaded ball is capable of rotating through a horizontal plane. When threaded rod 52 is rotated in a first direction, outward lateral forces are applied through stub 53 to move arm 48 and roller 38, away from slip form assembly 22. When rod 52 is rotated in a second direction, inward lateral forces are applied through stub 53 to urge arm 48 and roller 38, toward slip form assembly 22. Owing to their rotational capabilities, ball coupler 54 and stub 53 allow rod 52 to make small rotational excursions through a horizontal plane, as inward or outward adjustments of the impression roller 38 are made. A substantially identical construction is provided at the lower end of roller 38, to provide lateral adjustments for support arm 49 and the lower end of roller 38.

Using the aforementioned adjustable support system, the positions of rollers 38 and 39 are set so that their outer peripheries 43 are partially depressed into an exposed surface of the wet concrete, as it emerges from the discharge end 37 of the slip form assembly 22. In addition, the axis of rotation 42 of rollers 38 and 39 are set so that it is substantially parallel to the adjacent exposed surface of the wall 18.

Figure 3:
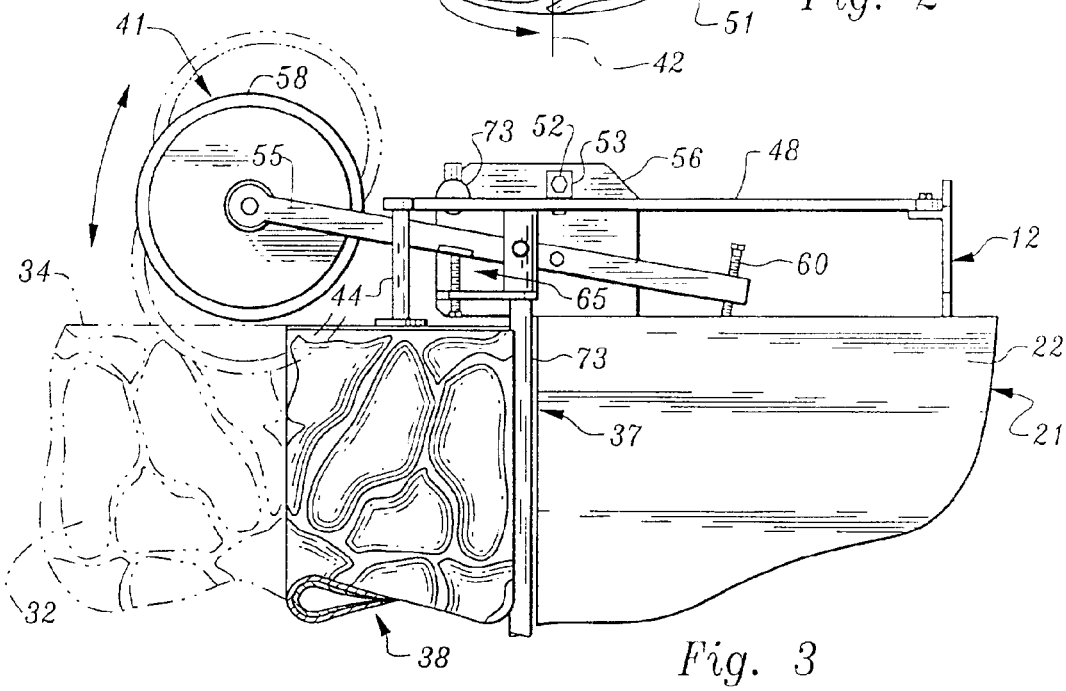
FIG. 3 is a side elevational view, particularly showing the top side roller and its adjustable mounting feature.

A similar arrangement is used to support top wall impression roller 41. One end of a pair of side support arms 45 supports roller 41 about its axis of rotation 42. An intermediate portion of the arms 45 is pivotally mounted to plates 56. A tensioning bolt 60 is provided at the end of each arm 45. Although gravity naturally presses impression roller 41 into the top wall to a certain extent, tensioning bolt 60 provides a fine adjustment for the extent of this impression, as indicated in FIG. 3. Limit stop assembly 65, including an adjustable bolt and an abutment plate, prevents impression roller 41 from extending too far into the top of the wall. Assembly 65 thereby works in conjunction with the tensioning bolt 60 to provide additional adjustable support for the roller 41, to ensure its proper vertical position with respect to the wall.

The impression rollers may be constructed in a number of different ways. It is preferred to employ a rigid, inner form 57, such as that provided by a right-circular cylindrical drum. The drum may be hollow, solid, or filled with honeycomb or foam reinforcement material. The inner form 57 provides support and an arcuate shape for the resilient outer periphery 43, containing the pattern to be impressed in the concrete wall.

Figure 2:
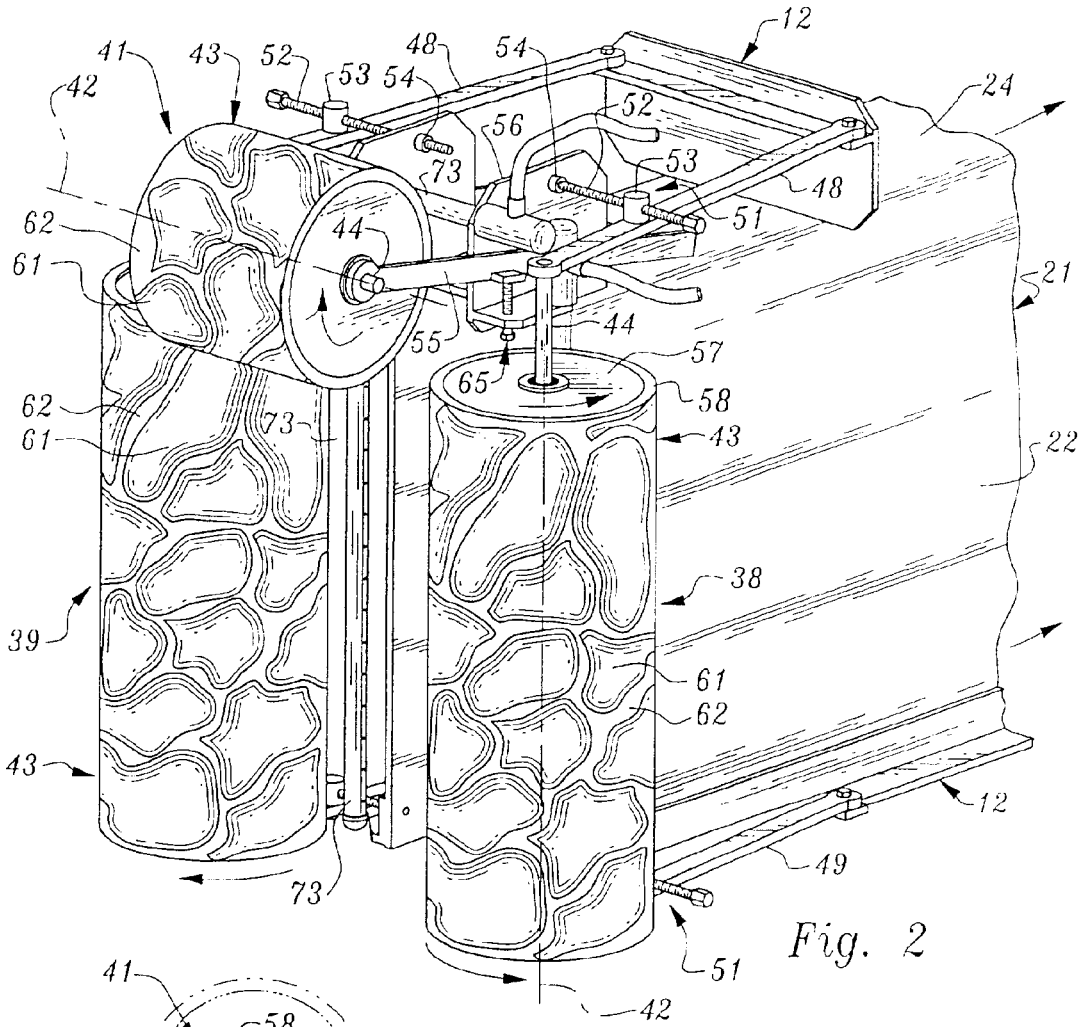
FIG. 2 is a perspective view showing the adjustable mounting arrangement for the three impression rollers and the slip-form.
Figure 6:
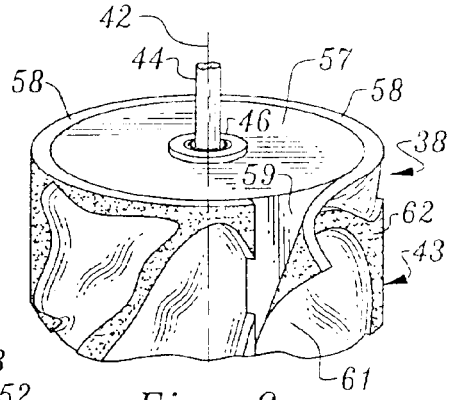
FIG. 6 is a fragmentary perspective view of an end of an impression roller, showing an edge portion of the adhesively applied silicon layer partially peeled away.

The resilient outer periphery 43 may be made from a moldable layer 58 of silicon-based material. It is preferred to use silicon-based material, or a functionally equivalent material, as it is curable from a liquid into a resilient layer. Through the use of a framed planar mold, any desired pattern may be formed in the lower surface of the mold. Then, the liquid silicon material, along with a curing agent, is poured into the mold. The liquid silicon is added to the fill the form until the layer is sufficiently thick and a planar upper surface is formed. After the silicon layer has fully cured, it may be peeled away from the mold. Then, through the use of a spray or brush-applied adhesive, the planar upper surface of layer 58 is wrapped around the right-circular cylindrical outer surface 59 of inner form 57 (see, FIGS. 2 and 6). In this manner, layer 58 substantially covers the outer surface of the form 57.

Virtually any type of three-dimensional pattern may be formed in the layer 58. For example, a pattern representing a plurality of random stone shapes 61 separated from each other by respective mortar lines 62, is shown in the impression rollers in FIG. 2. Of course the impression in the layer 58 is the negative of that which is impressed in the concrete wall. Thus, the random stone shapes 61 are depressed regions, and the mortar lines 62 are raised regions, as is most evident in FIG. 6.

Figure 10:
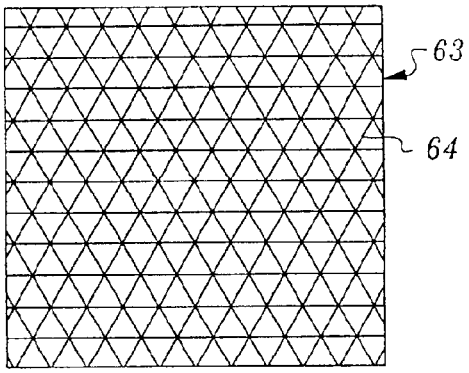
FIG. 10 is plan view of an alternative geometric pattern.
Figure 11:
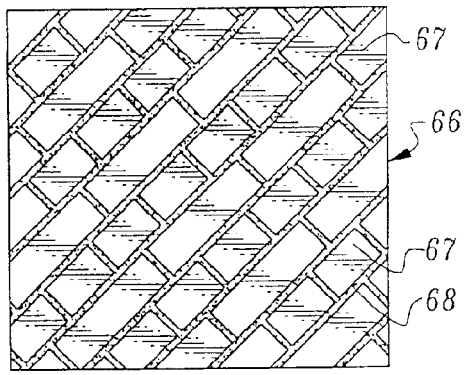
FIG. 11 is a plan view of an alternative brick and mortar pattern.
Figure 12:
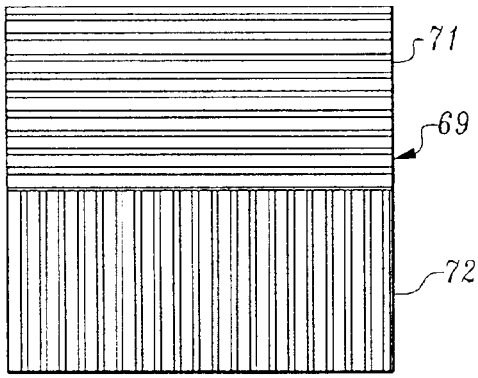
FIG. 12 is a plan view of yet another geometric pattern.

Other examples of three-dimensional patterns for the layer applied to an impression roller are shown in FIGS. 10–12 A layer 63, displaying a geometric pattern of straight, intersecting lines 64, is indicated in FIG. 10. Depending upon the desired impression in the concrete wall, the lines in the layer may be either raised or depressed. The layer 66 shown in FIG. 11, illustrates a brick 67 and mortar 68 pattern. To create a more realistic impression, the rectangular brick portions would be depressed and the dividing mortar portions would be raised, in the molded layer 66. In that way, the opposite three-dimensional pattern would be impressed in the concrete wall. Yet another example of a layer 69 is depicted in FIG. 12. In this pattern, upper lines 71 are arranged in horizontal alignment, and lower lines 72 are arranged in vertical alignment. It should be apparent that by using such a system, where the pattern is molded into a layer forming the outer periphery of the impression roller, the greatest flexibility in accomplishing the objects of the invention is achieved.

However, alternative constructions for the impression roller may be used. Rather than applying a separate molded layer to the roller, a three-dimensional texture could be sprayed onto all or part of the roller. Three dimensional objects, themselves containing patterns or providing an object pattern, could be affixed to the outer surface of the roller, either mechanically or adhesively. Also, the impression roller itself may be configured with flat sectors, or sections, to provide a three-dimensional pattern.

It has been determined that a resilient layer or coating is a significant feature for the impression roller of the present invention. Thus, irrespective of the configuration or construction of the roller, having a resilient outer periphery is necessary to form high-quality three-dimensional impressions in slip-formed walls. This stems primarily from the constituent makeup of the concrete 16 used in the slip-form process. As the concrete 16 is a very dry mix and includes more aggregate than a normal mix, an impression roller having a rigid outer periphery would tend to dislodge the aggregate and disrupt the integrity of the wall. The resilient layer, on the other hand, gives way when it encounters aggregate and smoothly rolls over such obstructions.

Figure 7:
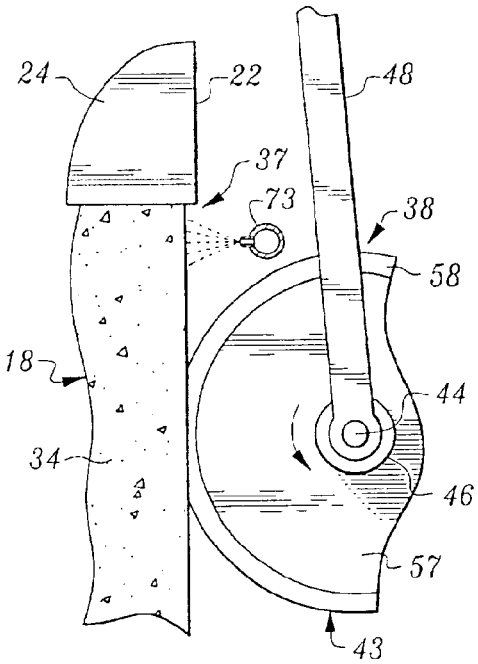
FIG. 7 is a top plan view of a sidewall impression roller, the release agent spray bar, and the slip-form.

Returning now to FIG. 2, a release agent spray bar 73 is shown. Spray bar 73 is located adjacent the discharge end 37 of the slip-frame assembly, so that a small amount of liquid release agent may be applied to all walls of the concrete wall 18 which are to be impressed with a pattern. (See, FIG. 7). Without the use of a release agent, the dry concrete mix tends to adhere to the impression roller, and deface the surface of the concrete wall. Spray bars 73 are therefore used not only for each of the sidewall impression rollers 38 and 39, but also for the top wall roller 41. As shown in FIG. 1, a release agent tank 74 and a pump 76 are mounted on the frame 12. Pump 76 provides a continuous supply of release agent to each of the spray bars.

Figure 8:
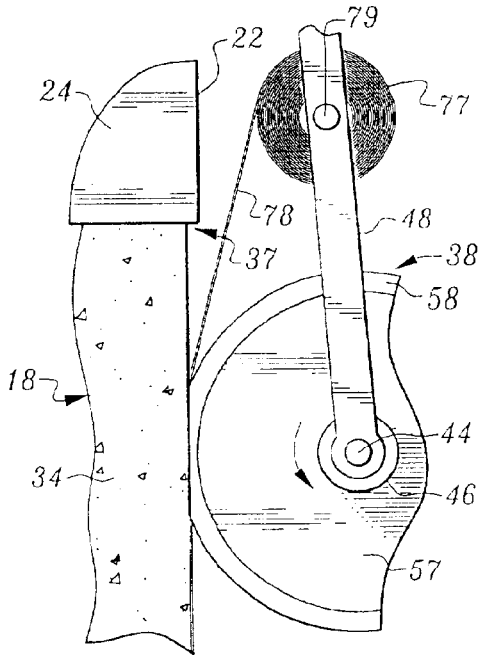
FIG. 8 is a top plan view of a sidewall impression roller, the VISQUINE roll, and the slip-form.
Figure 9:
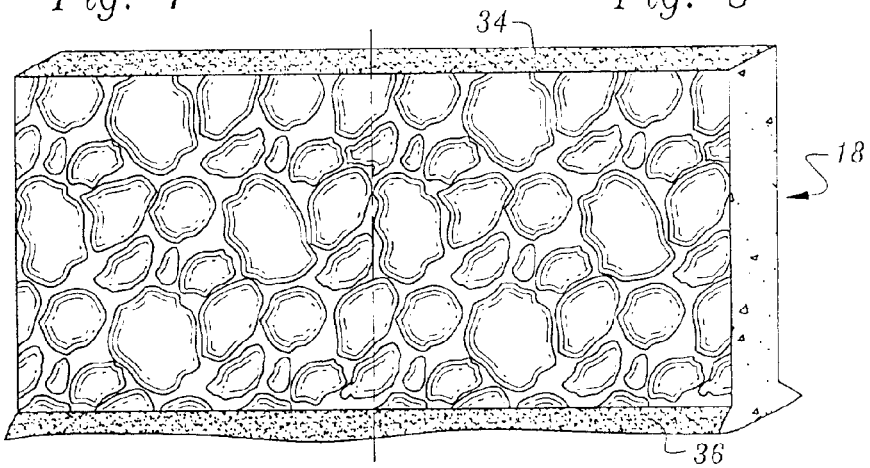
FIG. 9 is a side elevational view of a random stone and mortar pattern impressed in a slip-form wall, the broken center line representing the location of the matching edges, where the trailing edge of the first rolled impression meets the leading edge of the second rolled impression.

An alternative to the use of a liquid spray release agent is shown in FIG. 8. A roll 77 of a thin plastic film 78, such as VISQUINE, is mounted on a roll axle 78, secured between upper support arm 48 and lower support arm 49. The plastic film is captured between the impression roller and the concrete wall and sticks to the wet concrete after the impression is made. The film protects the outer periphery of the impression roller from being fouled during the impression process. Then, after the concrete in the wall has partially cured, the film is gently removed from the wall leaving the three-dimensional impression intact.

It should be apparent now that when the apparatus 11 is advanced forwardly, the support system for the impression rollers is advanced at the same speed and in the same direction as slip form assembly 22. Owing to this forward advancement and the surface engagement between the outer periphery of each of the impression rollers and the exposed surface of the wet concrete, each of the impression rollers is caused to rotate. With this rotation of the impression rollers, successive portions of their outer peripheries impress successive portions of the concrete wall with the three-dimensional pattern.

In carrying out the method of the present invention, the following steps are followed for continuously impressing a three-dimensional pattern into a slip-formed concrete wall: (1) continuously slip-forming a concrete wall, in which the concrete wall has parallel side walls and a top wall, with the top wall spanning a transverse distance between the side walls; (2) maintaining a layer of resilient material having a three-dimensional pattern therein in an arcuate configuration, the resilient layer having an axis of rotation; (3) partially depressing the resilient layer into an exposed surface of the concrete wall just emerging from the slip form, providing surface engagement between the pattern and the exposed surface; (4) continuously rotating the layer of resilient material about its axis of rotation, at the same rate as the wall continues to emerge from the slip-form; and, (5) maintaining the axis of rotation in substantially parallel relation to the exposed surface, so that a successive portion of the pattern will impress a successive exposed portion of the concrete wall.

Figure 13:
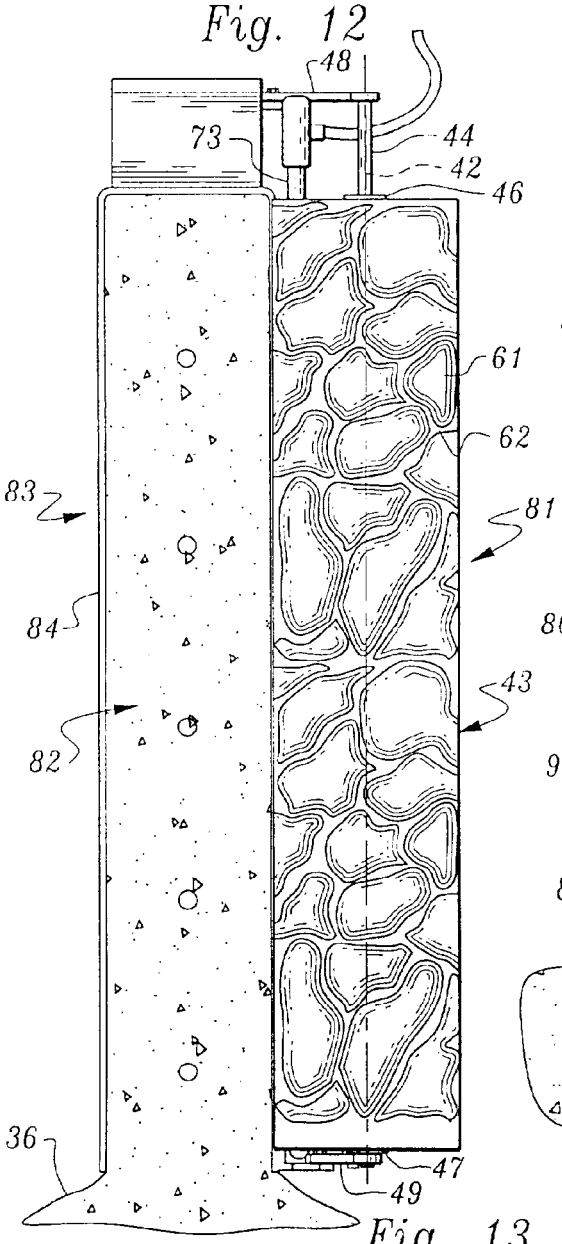
FIG. 13 is a rear elevational view of a slip-formed wall, in which only a single impression roller is used to provide a pattern in one sidewall; and, FIG. 14 is a rear elevational view of a tall slip-formed wall, showing a transition impression roller placing a pattern on one sidewall and upon the supporting foot of the wall.

FIG. 13 shows an implementation of the apparatus 11 of the present invention in which only a single sidewall impression roller 81 is employed. In this application, the three-dimensional pattern is only required to be impressed on one sidewall. In addition, the slip-formed concrete wall 82 is somewhat higher than that shown in the previous example. For these reasons, a slight modification is made to the slip-form assembly 83.

In the earlier described version of the invention, where an opposing pair of sidewall impression rollers 38 and 39 was employed, the lateral forces imposed against the wall 16 were opposing and equal. However, the lateral forces applied by the single impression roller 81 against the sidewall of the concrete wall 82 are unopposed. This circumstance is exacerbated by the fact that wall 82 is fairly high, making lateral displacement of the wall under the forces of the impression roller even more likely. Through the simple expedient of extending the length of the opposing side wall form 84, a force equal and opposing to forces imposed by the impression roller 81 is presented. In other words, side wall form 84 extends outwardly and downstream from the main slip form assembly 83, a distance slightly past the point where the outer periphery of the impression roller 81 engages the exposed surface of the wall 82. In this manner, the wall 82 will be fully laterally supported during the impression process. In all other respects, the features and operation of the apparatus shown in FIG. 13 is identical to that previously described.

Figure 14:
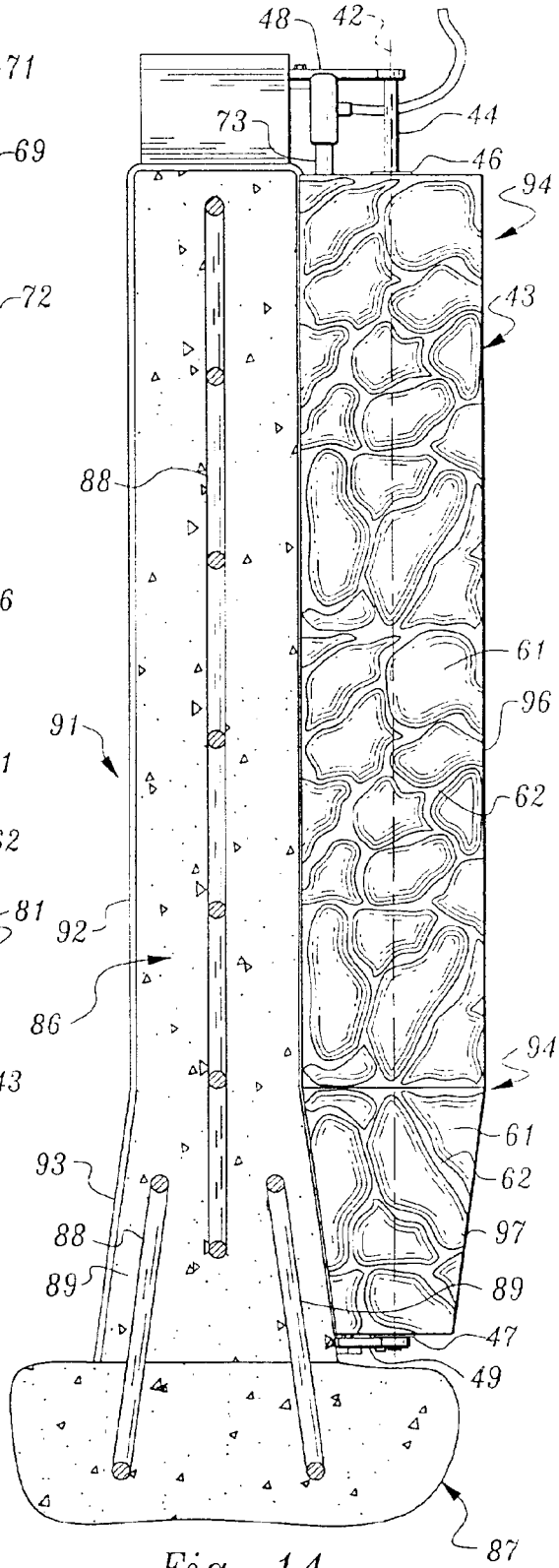

Yet another specialized application of the apparatus of the present invention is shown in FIG. 14. When a particularly tall slip-formed concrete wall 86 is to be made, a separate footing 87 is first poured, incorporating a reinforcement steel bar structure 88. Then, on a second pass of the apparatus, the concrete wall 86 is slip-formed so as to encompass and surround, the bar structure 88.

To provide additional strength and stability, it is desirable to form a flared-out skirt 89, at the base of the wall 86. Accordingly, slip-form assembly 91 includes a special extended side wall form 92 with an outwardly directed portion 93 to form one side of the side wall. The other side wall form (not shown), includes a complementary outwardly directed portion so as to form the other side of the skirt 89.

For the purpose of impressing a three-dimensional pattern in one side of this compound angled wall 86, a two-stage sidewall impression roller 94 is provided. Impression roller 94 includes an upper roller 96, which is elongated, and right-circular cylindrical in configuration. Roller 94 also includes a lower roller 97, which is frusto-conical in configuration. The rollers 96 and 97 are joined together, so as to rotate together at the same speed. As is evident from FIG. 14, upper roller 96 impresses a three-dimensional pattern in the exposed surface of the upper vertical section of wall 86, and lower roller 97 impresses a three-dimensional pattern on the exposed surface of the flared-out skirt 89. Of course, merely by adding another sidewall roller and a top wall roller, all three exposed surfaces of the wall 86 could be impressed with a three-dimensional pattern.

It will be appreciated, then, that I have described an apparatus and a method, for impressing aesthetically pleasing three-dimensional patterns in a slip-formed concrete wall.

What is claimed is:

1. An apparatus for impressing a three-dimensional pattern into a wet concrete wall formed by a slip form, comprising:

an impression roller having an axis of rotation and an outer periphery impressed with a three-dimensional pattern;

means for supporting said roller for rotation about said axis with said outer periphery being partially depressed into a first exposed side surface of the wet concrete wall emerging from the slip form, said axis of said roller being maintained substantially parallel to the first exposed surface;

means for supporting said roller for advancement along the concrete wall, whereby surface engagement between said outer periphery of said impression roller and the first exposed surface of the wet concrete cause said roller to rotate and impress successive portions of the wet concrete with successive portions of said three-dimensional pattern; and an opposing element displaced to engage a second exposed side surface opposite said first exposed side surface of said wall.

2. An apparatus as recited in claim 1, wherein said roller is elongated and right-circular cylindrical in configuration.

3. An apparatus as recited in claim 1, wherein said roller is elongated and has a two-stage outer periphery, a first stage being right-circular cylindrical in configuration and a second stage being frusto-conical in configuration.

4. An apparatus as recited in claim 1, wherein said outer periphery is made from a curable silicon, and in which said impression roller includes a rigid inner form having an outer surface, and in which said outer periphery substantially covers said outer surface.

5. An apparatus as recited in claim 1, wherein said means for supporting said roller for rotation comprises upper and lower arms rotatably attached to respective upper and a respective lower end of said impression roller, said arms extending from said means for supporting said roller for advancement.

6. An apparatus as recited in claim 1, further comprising means for applying a release agent on the wet concrete before it comes into contact with said outer periphery.

7. An apparatus as recited in claim 6, wherein said means for applying a release agent comprises a spray bar extending along said outer periphery.

8. An apparatus as recited in claim 1, further comprising means for applying a thin plastic film on the wet concrete before it comes into contact with said outer periphery.

9. An apparatus for impressing a three-dimensional pattern into a wet concrete wall formed by a slip form, comprising:

an impression roller, said roller having an axis of rotation and an outer periphery, at least a portion of said outer periphery including an outer layer of material having an outwardly facing pattern side, impressed with a three-dimensional pattern;

means for supporting said roller for rotation about said axis with said outer layer being partially depressed into a first exposed side surface of the wet concrete wall just emerging from the slip form, said axis of said roller being substantially parallel to the first exposed surface;

means for supporting said roller for advancement along the concrete wall, whereby surface engagement between said outer periphery of said impression roller and the first exposed surface of the wet concrete cause said roller to rotate and impress successive portions of the first exposed surface with said three-dimensional pattern; and an opposing element displaced to engage a second exposed side surface opposite said first exposed side surface of said wall.

10. An apparatus as recited in claim 9, wherein said roller is elongated and right-circular cylindrical in configuration.

11. An apparatus as recited in claim 9, wherein said roller is elongated and has a two-stage outer periphery, a first stage being right-circular cylindrical in configuration and a second stage being frusto-conical in configuration.

12. An apparatus as recited in claim 9, wherein said outer layer is made from a curable silicon, and in which said impression roller includes a rigid inner form having an outer surface, and in which said outer layer substantially covers said outer surface.

13. An apparatus as recited in claim 9, wherein said means for supporting said roller for rotation comprises upper and lower arms rotatably attached to a respective upper and a respective lower end of said impression roller, said arms extending from said means for supporting said roller for advancement.

14. An apparatus as recited in claim 9, further comprising means for applying a release agent on the wet concrete, before it comes into contact with said outer periphery.

15. An apparatus as recited in claim 14, wherein said means applying a release agent comprises a spray bar extending along said outer periphery.

16. An apparatus as recited in claim 9, further comprising means for applying a thin plastic film on the wet concrete before it comes into contact with said outer periphery.

17. An apparatus for slip-forming a concrete wall and impressing a three-dimensional pattern into an exposed surface of the wall, comprising:

an impression roller having an axis of rotation and an outer periphery impressed with a three-dimensional pattern;

means for supporting said roller for rotation about said axis with said outer periphery being partially depressed into a first exposed side surface of the wet concrete wall emerging from a slip form assembly at a discharge end, said axis of said roller being substantially parallel to the first exposed surface;

wherein said roller moves at the same speed and in the same direction as the forward advancement of said slip form assembly, whereby surface engagement between said outer periphery of said impression roller and the first exposed surface of the wet concrete cause said roller to rotate and impress successive portions of the concrete with said three-dimensional pattern; and an opposing element displaced to engage a second exposed side surface opposite said first exposed side surface of said wall.

18. An apparatus for impressing a three-dimensional pattern into a wet concrete wall formed by a slip form, comprising:

an impression roller having an axis of rotation and an outer periphery, at least a portion of said outer periphery impressed with a three-dimensional pattern;

upper and lower arms rotatably attached to a respective upper and a respective lower end of said impression roller;

said arms extending from a support frame;

said support frame configured for coupling to a slip form machine;

said arms configured to support said roller for rotation about said axis with said outer periphery being partially depressed into a first exposed side surface of the wet concrete wall emerging from said slip form, said axis of said roller being maintained substantially parallel to the first exposed surface;

whereby surface engagement between said outer periphery of said impression roller and the exposed surface of the wet concrete cause said roller to rotate and impress successive portions of the wet concrete with successive portions of said three-dimensional pattern; and an opposing element displaced to engage a second exposed side surface opposite said first exposed side surface of said wall.

19. An apparatus as recited in claim 18, wherein said outer periphery is made from a curable silicon, and in which said impression roller includes a rigid inner form having an outer surface, and in which said outer periphery substantially covers said outer surface.

20. An apparatus for impressing a three-dimensional pattern into a wet concrete wall formed by a slip form, comprising:

an impression roller having an axis of rotation and an outer periphery, at least a portion of said outer periphery including an outer layer of material having an outwardly facing pattern side, impressed with a three-dimensional pattern;

upper and lower arms rotatably attached to a respective upper and a respective lower end of said impression roller;

said arms extending from a support frame;

said support frame configured for coupling to a slip form machine;

said arms configured to support said roller for rotation about said axis with said outer periphery being partially depressed into a first exposed side surface of the wet concrete well emerging from said slip form, said axis of said roller being maintained substantially parallel to the exposed surface;

whereby surface engagement between said outer periphery of said impression roller and the first exposed surface of the wet concrete cause said roller to rotate and impress successive portions of the wet concrete with successive portions of said three-dimensional pattern; and an opposing element displaced to engage a second exposed side surface opposite said first exposed side surface of said wall.

21. An apparatus as recited in claim 20, wherein said outer layer is made from a curable silicon, and in which said impression roller includes an rigid inner form having an outer surface, and in which said outer layer substantially covers said outer surface.

22. An apparatus as recited in claim 1, 9, 17, 18, or 20, wherein said opposing element comprises:

a second roller displaced to engage a second exposed side surface opposite said first exposed side surface of said wall.

23. An apparatus as in claim 22, wherein the second roller has an outer periphery, at least a portion of said outer periphery impressed with a three-dimensional pattern to impress a pattern into said second exposed side surface.

24. An apparatus as recited in claim 1, 9, 17, 18, or 20, wherein said opposing element comprises:

a side wall form extending adjacent to a second exposed side surface opposite said first exposed side surface of said wall.

* * * * *